US009325068B2

(12) United States Patent
Chang

(10) Patent No.: US 9,325,068 B2
(45) Date of Patent: Apr. 26, 2016

(54) BROADBAND ANTENNA DEVICE

(71) Applicant: Arcadyan Technology Corporation, Hsinchu (TW)

(72) Inventor: Jin Su Chang, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 339 days.

(21) Appl. No.: 13/948,623

(22) Filed: Jul. 23, 2013

(65) Prior Publication Data

US 2014/0292607 A1 Oct. 2, 2014

(30) Foreign Application Priority Data

Mar. 28, 2013 (TW) ..... 102111267 A

(51) Int. Cl.
*H01Q 11/00* (2006.01)
*H01Q 5/371* (2015.01)

(52) U.S. Cl.
CPC ..... *H01Q 5/371* (2015.01)

(58) Field of Classification Search
CPC ..... H01Q 11/00; H01Q 1/24; H01Q 1/38
USPC ..... 343/843, 702, 700 MS, 846
See application file for complete search history.

(56) References Cited

U.S. PATENT DOCUMENTS 7,425,924 B2 * 9/2008 Chung ..... H01Q 1/38 343/702
7,464,341 B2 * 12/2008 Day ..... G06F 9/4443 715/781
8,547,283 B2 * 10/2013 Wong ..... H01Q 1/243 343/700 MS
2009/0273521 A1 * 11/2009 Wong ..... H01Q 1/38 343/700 MS
2009/0273530 A1 * 11/2009 Chi ..... H01Q 1/243 343/741

* cited by examiner

*Primary Examiner* — Huedung Mancuso
(74) *Attorney, Agent, or Firm* — Gottlieb, Rackman & Reisman, P.C.

(57) ABSTRACT

An antenna device is provided. The antenna device comprises a first radiation portion and a second radiation portion. The first radiation portion includes a first end and a second end. The second radiation portion is connected to the first end at a connecting part and includes a first arm and a second arm. The first arm and the second arm have different lengths and extend from the connecting part.

17 Claims, 4 Drawing Sheets

BROADBAND ANTENNA DEVICE

The present invention claims the benefits of priority from the Taiwanese Patent Application No. 102111267, filed on Mar. 28, 2013, the contents of the specification of which are hereby incorporated herein by reference

FIELD OF THE INVENTION

The present application relates to an antenna, particularly to a miniature wideband antenna.

BACKGROUND OF THE INVENTION

Whip antennas are the most common type of monopole antennas. The whip antennas consist of a single straight flexible wire or rod that usually protrudes from electronic devices such as mobile devices, routers and modems. In contrast to the whip antennas that protrude from the electronic devices, built-in antennas that are installed within electronic devices for proper operation offer a high degree of freedom of design. Not only because of this, but also from the standpoint of reinforcing shock resistance, reduction of manufacturing costs, etc., the requirement for complete built-in antennas for electronic devices, particularly mobile devices, is always growing.

The relative direction of a mobile device with its access point (base station) is determined not only by the orientation of the mobile device but also the location thereof. A challenge to the use of complete built-in antennas in mobile devices is that a mobile device can change its orientation through mobility and rotation. An antenna which is miniaturized and can only provide adequate gain for a limited range of orientations cannot meet the requirements for the mobile device, especially when it is moved or rotated.

In addition, for home wireless routers or modems, even if the whip antennas configured thereon have adjustable angles, the wireless signals transmitted from the wireless routers or modems will be affected by the place where the wireless router or modem is located. That is, metal objects, walls, floors and so on will interfere with the router's wireless signals, and the closer the router is to these obstructions, the more severe the interference is, and the weaker signal strength will be.

To overcome the mentioned problems, novel antenna devices are provided in the present disclosure after a lot of research, analysis and experiments by the inventors.

SUMMARY OF THE INVENTION

One of the purposes of the present invention is to downsize an antenna by the design of the meandering shape of an antenna without decreasing the radiation efficiency and narrowing the bandwidth thereof. Specifically, this purpose can be achieved by using two radiators electrically connected to each other and extending in different directions.

In accordance with one aspect of the present disclosure, an antenna device is described. The antenna device comprises a first radiation portion and a second radiation portion. The first radiation portion includes a first end and a second end. The second radiation portion is connected to the first end at a connecting part and includes a first arm and a second arm. The first arm and the second arm have different lengths and extend from the connecting part.

In accordance with another aspect of the present disclosure, an antenna device is described. The antenna device comprises an antenna area including at least one impedance matching structure and a ground area directly connected to the antenna area via the at least one impedance matching structure.

In accordance with a further aspect of the present disclosure, an antenna device is described. The antenna device comprises a first radiation portion, a second radiation portion and an impedance matching structure. The first radiation portion includes a first end and a second end. The second radiation portion is connected to the first end at a connecting junction. The second end includes a feeding point and the impedance matching structure is configured nearby the feeding point.

The above objectives and advantages of the present disclosure will become more readily apparent to those ordinarily skilled in the art after reviewing the following detailed descriptions and accompanying drawings, in which:

DETAILED DESCRIPTION OF THE PREFERRED EMBODIMENT

A detailed description of embodiments of the present invention is provided with reference to the FIGS. 1-11.

The present disclosure will now be described more specifically with reference to the following embodiments. It is to be noted that the following descriptions of preferred embodiments of this disclosure are presented herein for the purposes of illustration and description only; it is not intended to be exhaustive or to be limited to the precise form disclosed.

Figure 1:
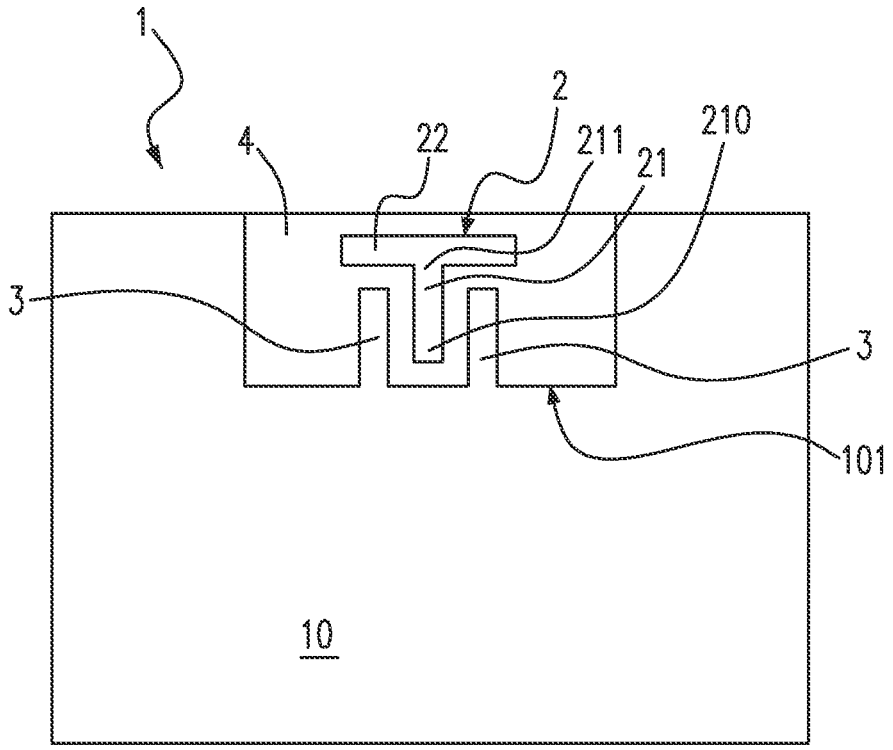
FIG. 1 is a diagram showing an antenna device according to a first embodiment of the present invention.

Please refer to FIG. 1, which shows an antenna device according to a first embodiment of the present invention. The antenna device 1, which is preferably a broadband antenna device, comprises a substrate 10. On the substrate 10, there is an antenna area 101 in which an antenna 2 is configured. The antenna 2 includes a first radiator 21 and a second radiator 22. The first radiator 21 includes a feeding end 210, which may be a feeding point, and a connecting end 211. The first radiator 21 of the antenna 2 of the present application is directly connected to the second radiator 22 via the connecting end 211. The connecting part between the first radiator 21 and the second radiator 22 forms a three-way junction, which is preferably a T-junction. The first and the second radiators 21, 22 have a bar shape and preferably a uniform width. The first and the second radiators 21, 22 on the substance 10 are rectangular-shaped radiators which extend in different directions, which are preferably opposite directions. Preferably, the extending direction of the first radiator 21 is perpendicular to that of the second radiator 22. Further, the long side of the second radiator 22 is connected to the connecting end 211 of the first radiator 21. That is, the short side of the first radiator 21 is connected to the long side of the second radiator 22. Based on the connecting end 211 of the first radiator 21, the second radiator 22 has a left arm and a right arm preferably with the same width. The left arm and the right arm extend from the three-way junction. The left arm may have a length the same as or different from that of the right arm. The feeding end 210 may route the RF signals via a coaxial cable, a microstrip line or coplanar waveguide (CPW) (not shown). The radiators in accordance with the present disclosure which extend in two different directions cause two different emission flats, and thus cover almost all emission directions.

In addition, a ground area (not shown) may be configured adjacent to the antenna area 101, and an impedance matching structure 3 may be configured between the second radiator 22 and the first radiator 21. The impedance matching structure 3 with an extending direction substantially the same as that of the first radiator 21 may be configured on either side or both sides of the first radiator 21. Further, in the antenna area 101, the space excluding the first radiator 21, the second radiator 22, and the impedance matching structure 3 may be filled with a dielectric substance to insulate the first and second radiators 21, 22 from the ground area (not shown). The portion excluding the antenna area 101 and the ground area on the substrate 10 may be provided with other electronic elements (not shown). In such conditions, a metal layer such as copper foil for the printed circuit board could be configured on said portion of the substrate 10 to electrically connect to other electronic elements. Said metal layer or the like and other electronic elements cannot be configured in the antenna area 101 either on the side where the antenna 2 lies or the side opposite thereto, i.e. the back of the substrate 10.

Figure 2:
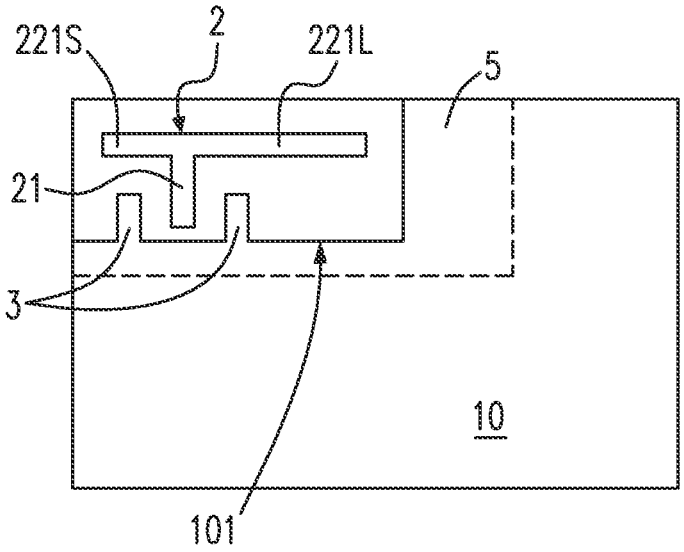
FIG. 2 is a diagram showing an antenna device according to a second embodiment of the present invention.

Please refer to FIG. 2, which shows an antenna device according to a second embodiment of the present invention. In this embodiment, the antenna area 101 is located at one of four corners of the substrate 10. In the antenna area 101, there is configured an antenna 2. The antenna 2 comprises a bar-shaped first radiator 21 with two ends. A first short arm 221S and a first long arm 221L are extended transversely from one end of the first radiator 21 in opposite directions. That is, the second embodiment shows a modification in the lengths of the left arm and the right arm of the second radiator 22 of the first embodiment in FIG. 1. Further, in the second embodiment, the impedance matching structures 3 are configured on both sides of the first radiator 21. It can be appreciated that the impedance matching structure 3 can be configured on either side or both sides of the first radiator 21.

Figure 3:
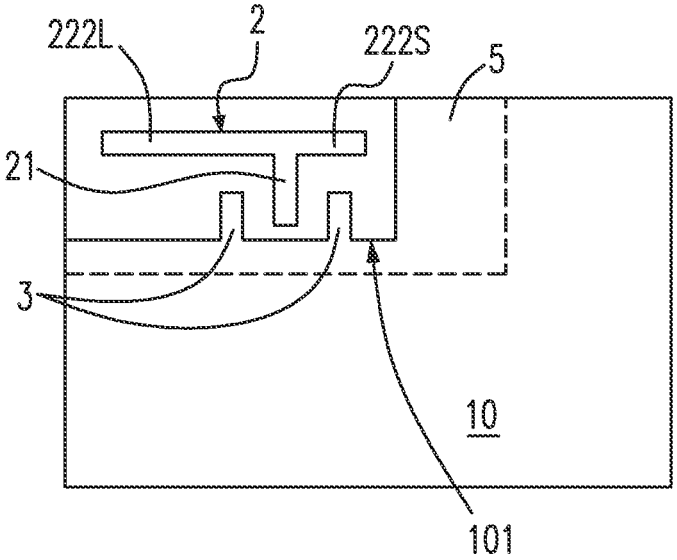
FIG. 3 is a diagram showing an antenna device according to a third embodiment of the present invention.

Please refer to FIG. 3, which is a diagram showing an antenna device according to a third embodiment of the present invention. In this embodiment, the antenna area 101 is located at one of four corners of the substrate 10. In the antenna area 101, there is configured an antenna 2. The antenna 2 comprises a bar-shaped first radiator 21 having two ends. A second short arm 222S and a second long arm 222L are extended transversely from one end of the first radiator 21 in opposite directions. Further, in the third embodiment, an impedance matching structure 3 is configured on either side of the first radiator 21 and electrically connected to the ground area 5 to reduce noise in the radio transmission and interference with other electronic elements (not shown) on the substrate 10.

Please continue to refer to FIGS. 2 and 3. Because one purpose of the present invention is to reduce the overall size of the antenna device, it is preferred that the antenna area 101 where the antenna 2 is located is designed inside the substrate 10, e.g. at four corners or near four sides thereof. Since the remaining portions on the substrate 10 may be used to set some electronic elements (not shown) to fully utilize the space in the antenna device such as a home wireless router or modem, a ground area 5 is configured around the antenna area 101 on the substrate 10 to avoid interference with said electronic elements on the remaining portions of the substrate 10. That is to say, the antenna area 101 is directly connected to the ground area 5 via the impedance matching structure 3. However, the ground area 5 may cause limitations in the voltage standing-wave ratio (VSWR), which is also referred to as standing-wave ratio (SWR). The smaller the VSWR is, the better the antenna is matched to the transmission line and the more power is delivered to the antenna. The minimum VSWR is 1.0, and in this case, no power is reflected from the antenna, which is ideal. Generally, to satisfy a bandwidth requirement without damaging the electronic elements, it is preferred to have a VSWR less than 3. On the premise that the VSWR is less than 3, the second embodiment with the first long arm 221L pointing to the ground area 5 is better than the third embodiment. That is to say, when the second and the third embodiments have the same bandwidth, the VSWR of the second embodiment in FIG. 2 is smaller than that of the third embodiment in FIG. 3. In other words, if the second and the third embodiments have the same VSWR, the second embodiment will have a bandwidth wider than that of the third embodiment. However, in the actual application, the concrete demand is the major consideration. Both the second and third embodiments can achieve the purpose of size reduction of the antenna devices according to the present application and providing vast coverage range for the electromagnetic waves.

Figure 4:
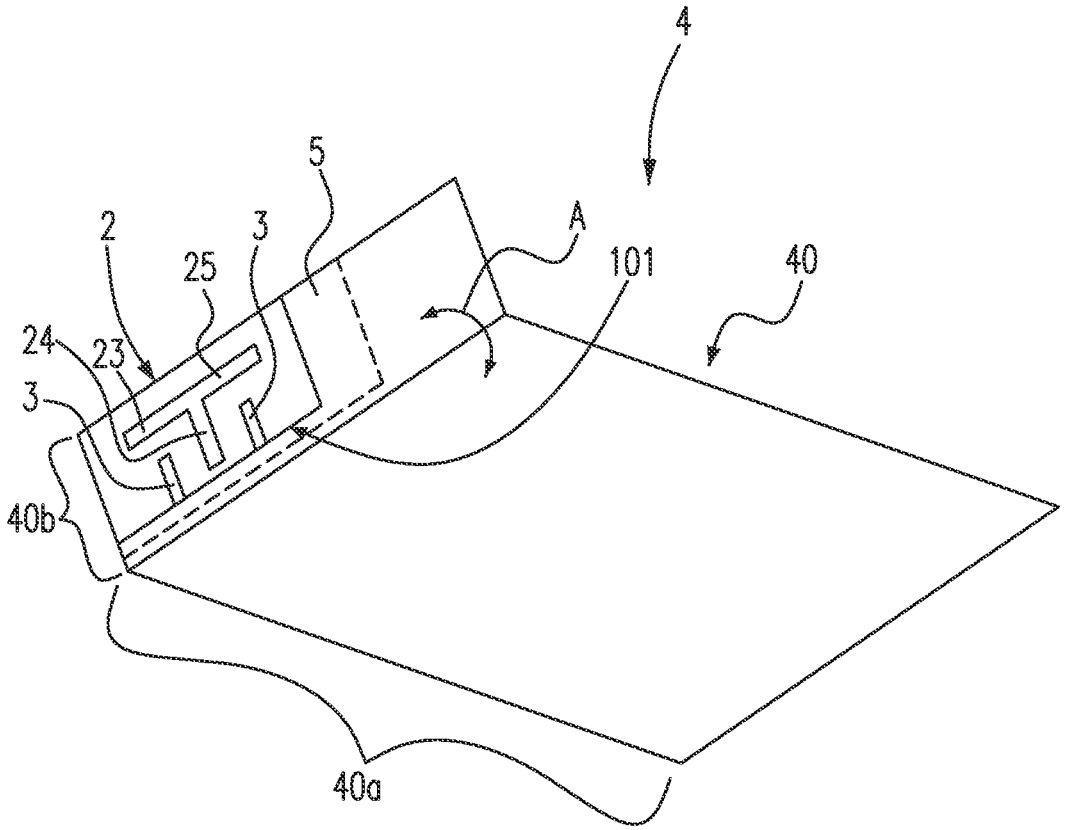
FIG. 4 is a diagram showing an antenna device according to a fourth embodiment of the present invention.

Please refer to FIG. 4, which is a diagram showing a broadband antenna device 4 according to a fourth embodiment of the present invention. The broadband antenna device 4 includes a flexible circuit board 40. The circuit board 40 has a first portion 40*a* and a second portion 40*b*, and the angle therebetween is denoted by the letter "A". An antenna area 101 where an antenna 2 is configured is disposed in the second portion 40*b* of the circuit board 40. The antenna 2 in this embodiment is a three-way intersectional antenna including a first arm 23, a second arm 24 and a third arm 25. The second arm 24 of the antenna 2 includes a feeding point. The antenna area 101 can be configured at the corner of the second portion 40*b*, so that tire remaining space on the second portion 40*b* can be used to place other electronic elements (not shown). In this case, because of the presence of other electronic elements, it is better to configure a ground area 5 around the antenna 2 on the second portion 40*b* to receive partial electromagnetic waves. One or more impedance matching structures 3 may be configured in the antenna area 101 in a manner similar to that described for the first embodiment. When the impedance matching structure 3 is a solo one, the solo impedance matching structure 3 is configured at a position being one of between the first and the second arms and between the second and the third arms, and when the impedance matching structure 3 has plural ones, the plural impedance matching structures 3 are separately configured between the first and the second arms and between the second and the third arms.

Figure 5:
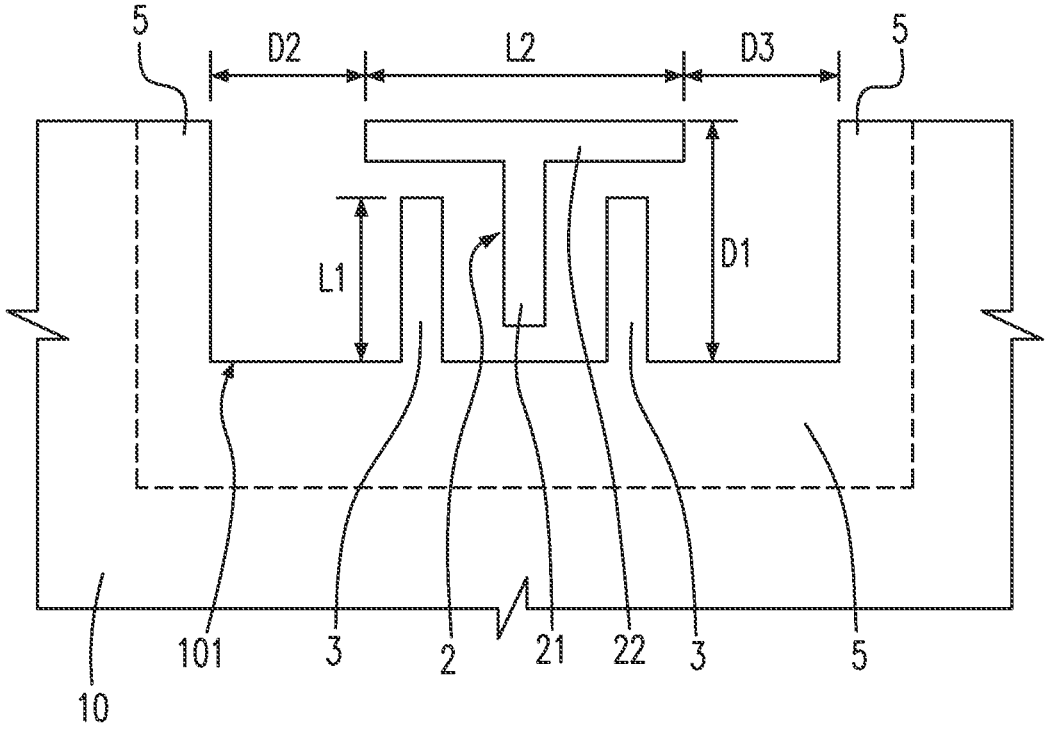
FIG. 5 is a diagram showing the dimension of an antenna device according to a fifth embodiment of the present invention.

Please refer to FIG. 5, which is a diagram showing the dimension of an antenna device according to a fifth embodiment of the present invention. The dimension is presented by λg, wherein 1 λg denotes one-guide wavelength of the center operating frequency of the operating frequency band in the medium on the condition that the VSWR is less than 3.0. In the fifth embodiment, the layout in the antenna area 101 including the antenna 2 and the impedance matching structures 3 is similar to that in the antenna area 101 of the first embodiment, and thus the descriptions therefor are omitted. The first radiator 21 and the second radiator 22 in the fifth embodiment form a T-shaped antenna 2 in the antenna area 101. The impedance matching structures 3 have an extending direction substantially the same as that of the first radiator 21 and a length L1 in its extending direction. The length L1 is in a range of 0-0.25 λg. The second radiator 22 has a length L2 in its extending direction as shown in FIG. 5. The length L2 is chosen such that 0.13 λg<L2<0.375 λg.

Since the antenna area 101 shares one side with the substrate 10, a ground area 5 is configured to surround the circumference excluding the shared side of the antenna area 101. That is, the antenna area 101 and the remaining portions on the substrate 10 are separated by the ground area 5. As shown in FIG. 5, the distance from the upper rim of the second radiator 22 to the ground area 5 is defined as a first distance D1. The first distance D1 is chosen such that 0.166 λg<D1<0.375 λg.

In FIG. 5, the second radiator 22 has a left end and a right end. The distance from the left end of the second radiator 22 to the ground area 5 is defined as a second distance D2, which is greater than 0.01756 λg. If possible, preferably the second distance D2 is greater than 0.166 λg. The distance from the right end of the second radiator 22 to the ground area 5 is defined as a third distance D3, which is greater than 0.166 λg. The maximums of the second distance D2 and the third distance D3 are not limited but depend on the dimension of the substrate.

The broadband antenna devices according to various embodiments in the present application have reduced dimensions and provide a much larger range of orientations due to the different orientations of the first and the second radiators. Since the two radiators are connected to each other at a particular angle, the radiation directions thereof intersect at that particular angle as well. The particular angle may be 90° or other appropriate angles. In each embodiment of the present disclosure, the radiating directions of the electromagnetic waves will be perpendicular to the long sides of the bar-shaped radiators, and thus the second radiator 22 in the T-shaped antenna would have a vertical radiating direction and the first radiator 21 in the T-shaped antenna would have a horizontal radiating direction. The reception or transmission of the electromagnetic waves in all directions can be achieved by using the antenna device based on the present disclosure. For a mobile communication device where the antenna device is configured, even if the mobile communication device is moved or rotated and thus the orientation of the antenna toward the base station changes, the antenna in the antenna device according to the present disclosure can effectively receive and transmit signals. For home wireless routers or wireless access points (AP), even if the router or AP is positioned near obstructions such as a wall, the emission of the electromagnetic waves from the antenna of the antenna device according to the present disclosure would not be obstructed. Based on the above, the layout of the antenna device according to the present disclosure can realize the downsizing of the overall antenna device and the increased directivity without decreasing the radiation efficiency or narrowing the bandwidth.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An antenna device, comprising:

a first radiation portion including a first end and a second end;

a second radiation portion connected to the first end at a connecting part and including a first arm and a second arm, wherein the first arm and the second arm have different lengths, extend from the connecting part and are a left arm and a right arm respectively;

a first impedance matching structure formed between the left arm and the first radiation portion; and a second impedance matching structure formed between the right arm and the first radiation portion.

2. An antenna device of claim 1, wherein the connecting part is a three-way junction, the left arm and the right arm are directly connected to and extend from the three-way junction and have a first and a second extension directions extending from the three-way junction, the first and the second extension directions are opposite to each other, and the first radiation portion and the second radiation portion are configured in an antenna area.

3. An antenna device of claim 2, further comprising a ground region adjacent to the antenna area.

4. An antenna device of claim 3, further comprising a dielectric substance configured in the antenna area and insulating the first and second radiation portions from the ground region.

5. An antenna device of claim 3, wherein the antenna area is surrounded by the ground region.

6. An antenna device of claim 1, wherein the first and the second impedance matching structures are electrically connected to the ground region.

7. An antenna device of claim 1, wherein the connecting part is a T-shaped junction.

8. An antenna device of claim 1, wherein the second end includes a feeding point.

9. An antenna device, comprising:

an antenna area including a plurality of impedance matching structures;

a ground area directly connected to the antenna area via the plurality of impedance matching structures; and a three-way intersectional antenna configured in the antenna area, wherein the three-way intersectional antenna includes a first arm, a second arm and a third arm, and the plural impedance matching structures are separately configured between the first and the second arms and between the second and the third arms.

10. An antenna device of claim 9, wherein the second arm includes a feeding point.

11. An antenna device of claim 10, wherein the first arm and the ground area have a nearest distance therebetween being greater than 0.166 kg.

12. An antenna device of claim 10, wherein the first arm has a first length and the third arm has a second length, and the second length is longer than the first length.

13. An antenna device of claim 12, wherein the third arm and the ground area have a nearest distance therebetween being greater than 0.166 kg.

14. An antenna device, comprising:

a first radiation portion including a first end and a second end, wherein the second end includes a feeding point;

a second radiation portion connected to the first end at a connecting junction and including a left arm and a right arm;

a first impedance matching structure configured near the feeding point and between the left arm and the first radiation portion; and a second impedance matching structure configured between the right arm and the first radiation portion.

15. An antenna device of claim 14, wherein the connecting junction is a three-way junction, and the left arm and the right arm have an identical width and extend from the three-way junction in two opposite directions.

16. An antenna device of claim 14, wherein the second radiation portion has a length ranging between 0.13-0.375 λg.

17. An antenna device of claim 14, wherein the impedance matching structure has a length greater than 0 λg and less than 0.25 λg.

* * * * *